US005666601A

United States Patent [19]

Genovese et al.

[11] Patent Number: 5,666,601

[45] Date of Patent: Sep. 9, 1997

[54] RESISTIVE ION SOURCE CHARGING DEVICE

[75] Inventors: Frank C. Genovese, Fairport; Richard F. Bergen, Ontario, both of N.Y.

[73] Assignee: Xerox Corporation, Stamford, Conn.

[21] Appl. No.: 738,980

[22] Filed: Aug. 1, 1991

[51] Int. Cl.[6] ..... G03G 15/02

[52] U.S. Cl. ..... 399/168

[58] Field of Search ..... 355/219, 221, 355/210; 250/324, 325, 326; 361/225; 399/168

[56] References Cited

U.S. PATENT DOCUMENTS

| | | | |
|---|---|---|---|
| 2,892,973 | 6/1959 | Straughan | 355/219 X |
| 4,248,951 | 2/1981 | Ando et al. | 355/211 X |
| 4,571,052 | 2/1986 | Shirai | 355/274 |
| 4,585,323 | 4/1986 | Ewing et al. | 250/325 |
| 4,593,994 | 6/1986 | Tamura et al. | 355/219 X |
| 4,641,955 | 2/1987 | Yuasa | 250/324 X |
| 4,706,320 | 11/1987 | Swift | 355/219 X |
| 4,761,709 | 8/1988 | Ewing et al. | 355/219 X |
| 4,794,254 | 12/1988 | Genovese et al. | 250/324 |
| 4,803,593 | 2/1989 | Matsumoto et al. | 361/225 |
| 4,839,670 | 6/1989 | Snelling | 355/219 |
| 4,963,738 | 10/1990 | Gundlach et al. | 250/326 |
| 4,996,425 | 2/1991 | Hauser et al. | 250/325 |

*Primary Examiner*—Sandra L. Brase
*Attorney, Agent, or Firm*—Denis A. Robitaille

[57] ABSTRACT

A device for depositing charge on a charge retentive surface including an insulative support substrate coated with a layer of highly resistive material and a high voltage bus coupled thereto for providing a high voltage potential across the resistive material layer. The resistive charging device is positioned in contact with or in close proximity to a charge retentive surface to provide a uniform charging potential for depositing ions onto the charge retentive surface.

22 Claims, 3 Drawing Sheets

RESISTIVE ION SOURCE CHARGING DEVICE

The present invention relates generally to corona charging devices for use in electrostatographic applications, and more particularly concerns a resistive corona generating device for depositing charge on an adjacent surface.

Generally, the process of electrostatographic copying is executed by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. This latent image is subsequently developed into a visible image by a process in which a charged developing material is deposited onto the photoconductive surface of the photoreceptor such that the developing material is attracted to the charged image areas thereon. The developing material is then transferred from the photoreceptive member to a copy sheet on which the image may be permanently affixed to provide a reproduction of the original document. In a final step, the photoconductive surface of the photoreceptive member is cleaned to remove any residual developing material therefrom in preparation for successive imaging cycles.

The described process is well known and is useful for light lens copying from an original, as well as, for printing applications from electronically generated or stored originals. Analogous processes also exist in other electrostatographic applications such as, for example, ionographic applications, where charge is deposited on a charge retentive surface in accordance with an image stored in electronic form.

In electrostatographic applications, it is common practice to use wire corona generating devices for providing electrostatic fields to drive various machine operations. Such corona devices are primarily used to deposit charge on the photoreceptive member prior to exposure to the light image for subsequently enabling toner transfer thereto. In addition to precharging the imaging surface of an electrostatographic system prior to exposure, corona devices can be used in the transfer of an electrostatic toner image from a photoreceptor to a transfer substrate, in tacking and detacking paper to or from the imaging member by neutralizing charge on the paper, and, generally, in conditioning the imaging surface prior to, during, and after the deposition of toner thereon to improve the quality of the xerographic output copy. Both DC and AC type corona devices are used to perform many of the above functions.

Corona devices normally incorporate at least one fine wire, sometimes called a coronode, and a shield that encloses the coronode on three sides. The coronode is made of a good conductor having robust chemical properties as found in tungsten or platinum, and is connected to a power supply which applies a high voltage to the coronode to generate ions or a charging current, thereby charging a dielectric surface closely adjacent to the device. Such corona devices may contain screens and/or auxiliary coronodes as well as various additional conductive shields for regulating the charging current or controlling the uniformity of charge deposited.

The conventional form of corona discharge device used in electrostatographic reproduction systems is generally shown in U.S. Pat. No. 2,836,725, wherein a conductive corona electrode in the form of an elongated wire is partially surrounded by a conductive shield. The corona electrode is provided with a DC voltage, while the conductive shield is usually electrically grounded. The dielectric surface to be charged is spaced from the wire on the side opposite the shield and is mounted on a grounded substrate. Alternatively, the corona device may be biased in a manner taught in U.S. Pat. No. 2,879,395 wherein an AC corona generating potential is applied to the conductive wire electrode and a DC potential is applied to a conductive shield partially surrounding the electrode. This DC potential regulates the flow of ions from the electrode to the surface to be charged. Because of this DC potential, the charge rate can be adjusted, making this biasing system ideal for self regulating systems. Other biasing arrangements are known in the prior art and will not be discussed in great detail herein.

Several problems have historically been associated with the corona generating devices of the prior art. The most notable problem centers around the inability of such corona devices to provide a uniform charge density along the length of the wire, resulting in a corresponding variation in the magnitude of charge deposited on associated portions of the adjacent surface to be charged. Other problems include arcing caused by non-uniformities between the coronode and the surface being charged, vibration and sagging of corona wires, contamination of corona wires, and, in general, inconsistent corona performance due to the effects of humidity and airborne chemical contaminants on corona devices. A secondary consideration is the fact that corona devices are costly to manufacture.

Various approaches and solutions to the problems inherent to the use of suspended wire coronode charging devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. Published Japanese Patent Application No. 58-48073 to Momotake teaches a charging device for selectively charging portions of the image area of a photoreceptor having rectangular discharging electrodes supported on a glass insulator. U.S. Pat. No. 4,353,970 discloses a bare wire coronode attached directly to the outside of a glass coated secondary electrode. U.S. Pat. No. 4,562,447 discloses an ion modulating electrode that has a plurality of apertures capable of enhancing or blocking the passage of ion flow through the apertures.

The following disclosures may be relevant to various aspects of the present invention:

U.S. Pat. No. 4,571,052 patentee: Shirai issued: Feb. 18, 1986

U.S. Pat. No. 4,803,593 patentee: Matsumoto, et al. issued: Feb. 7, 1989

U.S. Pat. No. 4,794,254 patentee: Genovese, et al. issued: Dec. 27, 1988

U.S. Pat. No. 4,963,738 patentee: Gundlach, et al. issued: Oct. 16, 1990

The relevant portions of the foregoing disclosures may be briefly summarized as follows:

U.S. Pat. No. 4,571,052 discloses a method and device for transferring toner image from the surface of a photosensitive plate to a sheet of paper. The transfer device of that patent comprises a conductive member disposed between a substrate and a coating layer wherein a high DC voltage is applied across the elongated conductive member such that a narrow electric field is created between the elongated conductive member and the surface of the photosensitive plate for providing an electric field for toner transfer.

U.S. Pat. No. 4,803,593 discloses a flat solid discharging device for charging or discharging a photoconductive element wherein first and second electrodes are juxtaposed through a dielectric element. An AC voltage is applied across the first and second electrodes to produce ions in the vicinity of the two electrodes. The first electrode has a hairline configuration extending along the length of the device while the second electrode comprises a plurality of conductive strips extending crosswise relative to the first electrode. By using the device of this patent, irregularities in charging corresponding to the pitch of the conductive strips are made negligible.

U.S. Pat. No. 4,794,254 discloses a distributed resistive corona discharging device including an insulating substrate, a resistive material layer deposited on the substrate, and a plasma gap separating the resistive material layer into at least two resistive material regions. A voltage is applied to the resistive material regions through electrodes arranged on the resistive material regions to provide a uniform resistance between the power supply and the points on the resistive material regions immediately adjacent to the plasma gap. This distributive resistance corona generating device is inherently self-regulating to provide a uniform charging potential along the plasma gap.

U.S. Pat. No. 4,963,738 shows a charging device that includes a comb-like electrode which is silk screened onto a supporting dielectric substrate. The teeth of the comb-like electrode of this patent extend to an edge of the dielectric substrate, positioned relative to a slit or a screen to provide electric field lines emerging from the edge face of the dielectric.

In accordance with the present invention, a device for generating ions is disclosed, comprising a power supply coupled to a conductive coating which is further coupled to a resistive coating disposed on and extending to an edge of an insulating support substrate. The power supply provides a voltage potential across the resistive coating via the conductive coating, yielding uniform distribution of potential across the resistive coating to emit ions along the edge of the device.

In accordance with another aspect of the invention, a configuration is provided wherein portions of the resistive material layer are segmented and controllably driven to provide selective charging of the charge retentive surface. The segmented resistive material layer can include a central charging segment and at least a pair of side charging segments on either side thereof to symmetrically or asymmetrically charge selective portions of the charge retentive surface, as desired.

Pursuant to a particular aspect of the invention, an electrostatographic printing apparatus is provided with at least one of the resistive ion source charging device as described herein.

These and other aspects of the present invention will become apparent from the following description in conjunction with the accompanying drawings in which.

While the present invention will be described in connection with a preferred embodiment thereof, it will be understood that it is not intended that the invention be limited to this preferred embodiment. On the contrary, the present invention is intended to cover all alternatives, modifications, and equivalents as may be included within the spirit and scope of the invention as defined by the appended claims.

Figure 1:
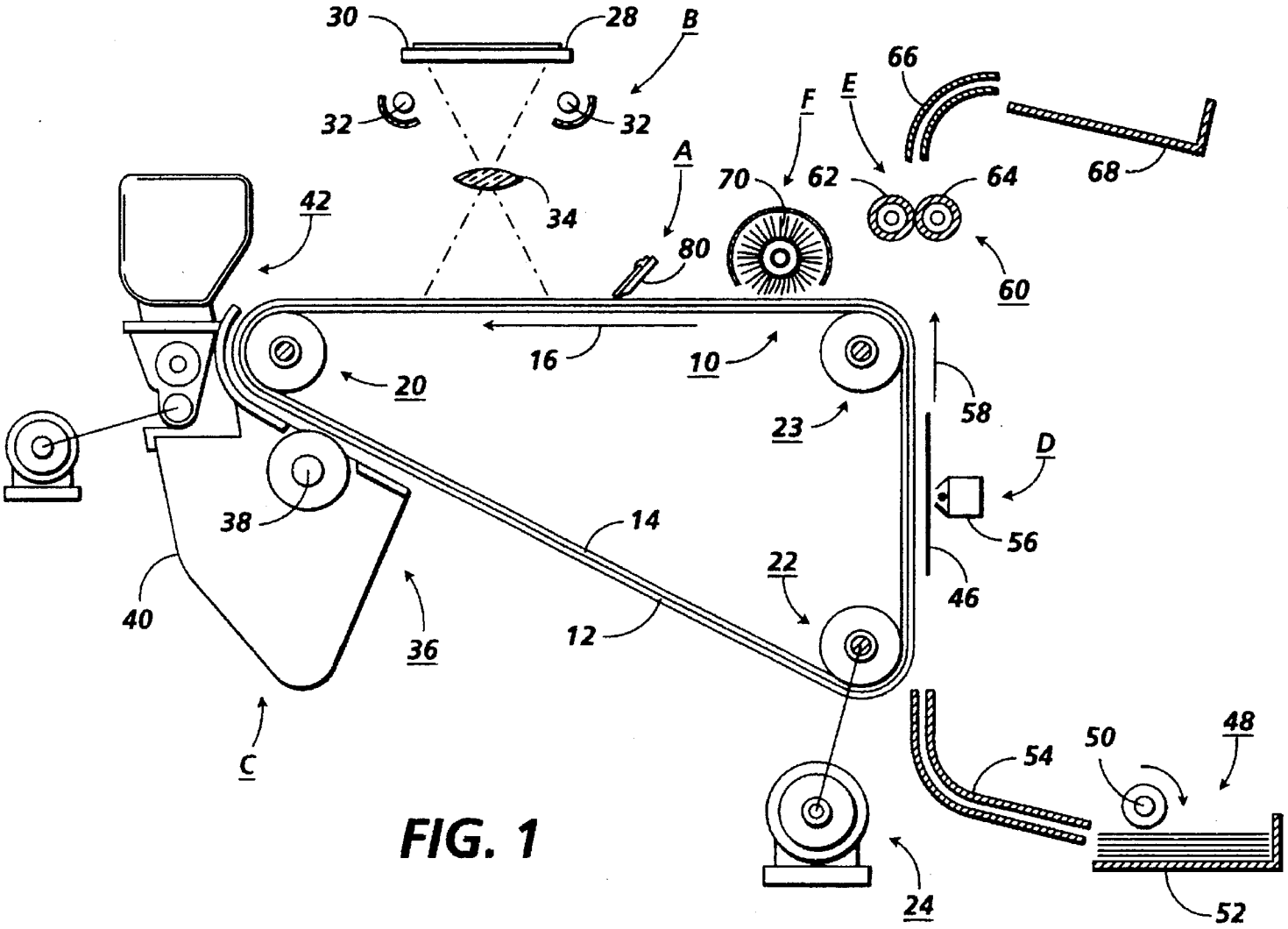
FIG. 1 is a schematic elevational view showing an electrophotographic copier employing the features of the present invention.

For a general understanding of the features of the present invention, reference is made to the drawings wherein like reference numerals have been used throughout to designate identical elements. Referring now to FIG. 1, a schematic depiction of the various components of an exemplary electrophotographic reproducing apparatus incorporating the resistive ion source charging structure of the present invention is provided. Although the apparatus of the present invention is particularly well adapted for use in an automatic electrophotographic reproducing machine, it will become apparent from the following discussion that the present resistive ion source charging structure is equally well suited for use in a wide variety of electrostatographic processing machines and is not necessarily limited in its application to the particular embodiment or embodiments shown herein. In particular, it should be noted that the charging apparatus of the present invention, described hereinafter with reference to an exemplary charging system, may also be used in a toner transfer, detack, or cleaning subsystem of a typical electrostatographic apparatus since such subsystems also require the use of a charging device.

The exemplary electrophotographic reproducing apparatus of FIG. 1 employs a belt 10 including a photoconductive surface 12 deposited on an electrically grounded conductive substrate 14. Drive roller 22, coupled to motor 24 by any suitable means, as for example a drive belt, engages with belt 10 to move belt 10 about a curvilinear path defined by the drive roller 22, and tension rollers 20, 23, which are each rotatably mounted. This system of rollers is used for advancing successive portions of photoconductive surface 12 in the direction of arrow 16 through various processing stations disposed about the path of movement thereof, as will be described.

Initially, a portion of belt 10 passes through charging station A. At charging station A, a charging structure in accordance with the present invention, indicated generally by reference numeral 80, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source form a light image of the original document which are reflected and transmitted through lens 34. Lens 34 focuses the light image onto the charged portion of photoconductive surface 12 to selectively dissipate the charge thereon, thereby recording an electrostatic latent image corresponding to the original document 28 onto photoconductive surface 12. Although an optical system has been shown and described for forming the light image of the information used to selectively discharge the charged photoconductive surface 12, one skilled in the art will appreciate that a properly modulated scanning beam of energy (e.g., a laser beam) may be used to irradiate the charged portion of the photoconductive surface for recording the latent image thereon.

After the electrostatic latent image is recorded on photoconductive surface 12, belt 10 advances to development station C where a magnetic brush development system, indicated generally by the reference numeral 36, deposits developing material onto the electrostatic latent image. Magnetic brush development system 36 includes a single developer roller 38 disposed in developer housing 40. Toner particles are mixed with carrier beads in the developer housing 40, creating an electrostatic charge therebetween which causes the toner particles to cling to the carrier beads and form developing material. The developer roller 38 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. A toner particle dispenser, indicated generally by the reference numeral 42, furnishes additional toner particles to housing 40.

After the toner particles have been deposited onto the electrostatic latent image for development thereof, belt 10 advances the developed image to transfer station D, where a sheet of support material 46 is moved into contact with the developed toner image via sheet feeding apparatus 48 and chute 54. Preferably, sheet feeding apparatus 48 includes a feed roller 50 for rotation while in contact with the uppermost sheet of stack 52 to advance the uppermost sheet into chute 54. Chute 54 directs the advancing sheet of support material 46 into contact with photoconductive surface 12 of belt 10 in a timed sequence so that the developed image thereon contacts the advancing sheet of support material 46 at transfer station D. A corona generating device 56 is provided for projecting ions onto the backside of sheet 46 to aid in inducing the transfer of toner from the developed image on photoconductive surface 12 to support material 46. While a conventional coronode device is shown as corona generating device 56, it will be understood by those of skill in the art that the resistive ion source charging device of the present invention can be substituted for the coronode device 56. The support material 46 is subsequently transported in the direction of arrow 58 for placement onto a conveyor (not shown) which advances the sheet to a fusing station E.

Fusing station E includes a fuser assembly, indicated generally by the reference numeral 60, for permanently affixing the transferred image to sheet 46. Fuser assembly 60 preferably comprises a heated fuser roller 62 and a support roller 64 spaced relative to one another for receiving a sheet of support material 46 therebetween. The toner image is thereby forced into contact with the support material 46 between fuser rollers 62 and 64 to permanently affix the toner image to support material 46. After fusing, chute 66 directs the advancing sheet of support material 46 to receiving tray 68 for subsequent removal of the finished copy by an operator.

Invariably, after the support material 46 is separated from the photoconductive surface 12 of belt 10, some residual developing material remains adhered to belt 10. Thus, a final processing station, namely cleaning station F, is provided for removing residual toner particles from photoconductive surface 12 subsequent to separation of the support material 46 from belt 10. Cleaning station F can include a rotatably mounted fibrous brush 70 for physical engagement with photoconductive surface 12 to remove toner particles therefrom by rotation of brush 70 thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of specific electrostatographic processing subsystems or processes may be expected without affecting the operation of the present invention.

Figure 2:
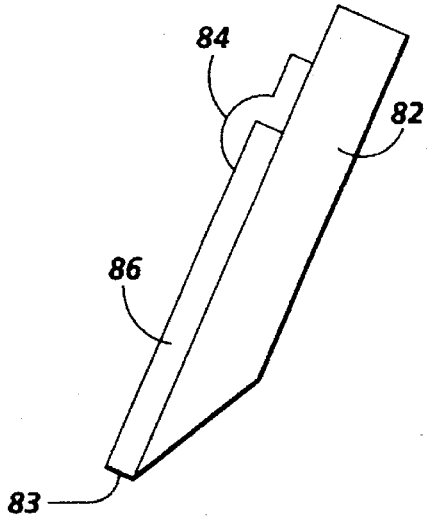
FIG. 2 is a side view of the resistive ion source charging device of the present invention.
Figure 3:
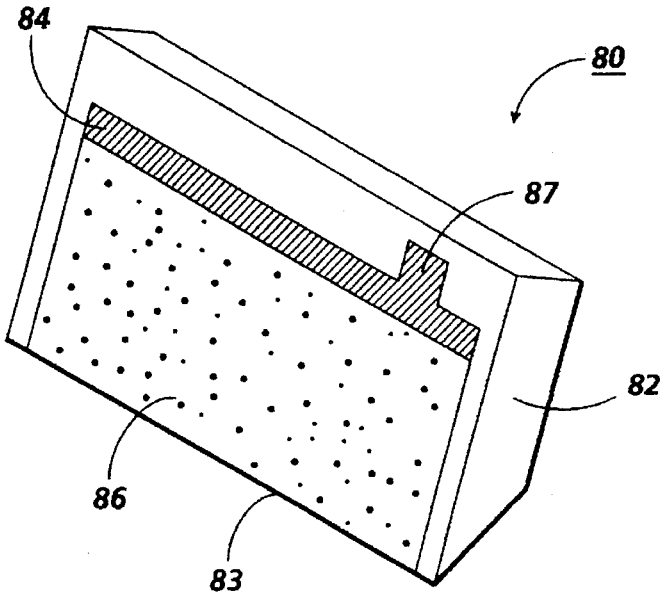
FIG. 3 is a perspective view of the resistive ion source charging device of FIG. 2.

Referring now more particularly to FIGS. 2 and 3 and to the specific subject matter of the present invention, an exemplary resistive ion source charging structure 80 is illustrated and described in greater detail. The primary components of the resistive ion source charging structure are insulating substrate 82, voltage (HV) bus 84 and resistive layer 86.

In a preferred embodiment, the charging structure comprises an insulating substrate 82 defined by a planar member of glass or glass-like material such as alumina or other ceramic material. The insulating substrate is selectively coated with a thin coating of resistive material forming resistive layer 86 which contacts high voltage bus 84. The resistive material may be a resistive paint or ink having a uniform thickness. Satisfactory materials are available from DuPont Corporation, Wilmington, Del., having a resistance on the order of approximately 100 megohms per square. Other suitable resistive materials range in resistivity from 1–1,000 megohms per square. In the simplest case, the resistive layer 86 may be painted onto insulating substrate 82 wherein the layer of resistive material is allowed to dry and is subsequently fired at high temperatures to impart a glass-like hardness and resistive electrical properties in accordance with manufacturer's specifications. Alternatively, since uniformity of the thickness of the resistive material 86 is an important factor in providing uniform charge output along the length of the structure, sputtering or evaporation or other means of depositing thin film resistive coating materials onto the substrate 82 is also possible.

Figure 4:
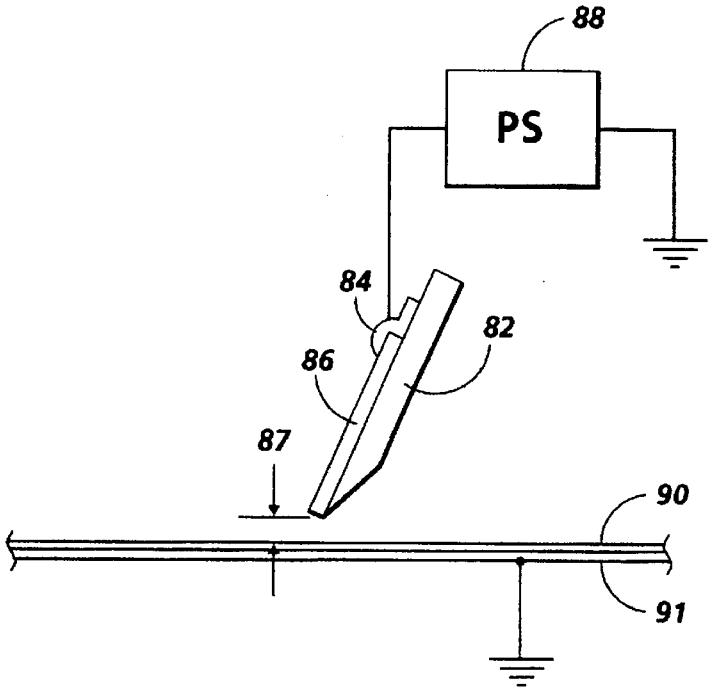
FIG. 4 is a schematic view of the resistive ion source charging structure of the present invention as installed in an electrophotographic copier for providing uniform charge deposition on a dielectric layer.

It will be seen from FIGS. 3 and 4 that HV bus 84 extends substantially along the length of resistive layer 86 and is connected to high voltage power source 88. HV power source 88 provides a voltage potential to the resistive layer 86 via contact tab 87. For the purpose of charging uniformity, the resistance between HV bus 84 and resistive edge 83 of resistive coating 86 should be the same for each point on the resistive edge 83. Further, the resistance between the HV bus 84 and the resistive edge 83 may be trimmed by adding a conductive paint extending across the HV bus 84 to cover a portion of the resistive material region 86, thereby modifying the resistance to the resistive edge 83 to enhance charging uniformity. It will be understood by one of skill in the art that the overall resistance of the device can be modified by the type of resistive material used as well as the amount of resistive material used. Therefore, the dimension of the resistive layer 86 can be varied, as desired. Other methods of trimming the resistive material layers to obtain uniform current flow through the lengths of the resistive regions are also possible.

High voltage source 88 preferably provides a DC voltage operating in the range of approximately 5 kilovolts for powering the device of the present invention, although greater voltage potentials and/or the use of an AC voltage source may be contemplated. It should be noted, however, that the potential of an AC voltage source will be partially attenuated by parasitic capacitances in the device and is therefore not preferred.

The resistive ion source charging structure of the present invention may be supported in a closely spaced relation, and in various angular relation to a dielectric substrate, generally referred to as photoconductive surface 12 in FIG. 1 and surface 90 in FIG. 4, for applying a charge thereto. The air gap 87 separating the charging structure of the present invention and the a dielectric substrate 90 can range from 0–10 mm in height. Thus, it is an advantage of the present device that it may be closely spaced to or, may, in fact, be placed in substantial contact with a surface to be charged.

Close spacing of the charging device relative to the surface to be charged results in charged areas which are defined by very sharp boundaries, having minimal dissipation of the charging current outside the area most proximate to the device. Placing the device close to the surface to be charged provides a further benefit by reducing breakdown voltage needed for corona generating and by limiting arcing current as well as providing a more regulated charging current output for various non-electrophotographic purposes.

It should be noted that the placement of the charging structure of the present invention in direct contact with the surface to be charged may employ various charging mechanisms. That is, assuming a sufficiently high voltage potential applied to the bus 84, a corona can be generated along the air region adjacent the boundary between the resistive layer 86 and the dielectric substrate 90. Conversely, by applying a lower voltage to the bus 84, such that no corona is generated, a simple charge transfer can occur between the resistive edge 83 and the dielectric substrate 90. Typically, a substantially low voltage is applied to the bus 84. Additionally, it should be noted that proper selection of the resistance of the resistive material can provide supplemental benefits. That is, in the event that a hole exists or forms in the dielectric substrate 90 such that the resistive edge 83 makes direct contact with the ground plane 91 below, any arcing current will be restricted by the resistive layer 86 so that the device will not be damaged or the dielectric substrate will not be further damaged.

When the charging structure is spaced a distance away from the dielectric substrate 90 forming air gap 87, the usual charging mechanisms associated with corona breakdown are employed. That is, sufficiently high voltage is delivered to bus 84 to produce a corona at the resistive material edge 83 so that the ions generated flow across the air gap 87 from resistive edge 83 to the dielectric substrate 90. In fact, in this configuration, the charging device of the present invention makes extremely efficient use of the ions generated wherein substantially 100% of the ions generated are delivered to the dielectric substrate.

Since the resistive ion source charging structure of the present invention is intended for use as an alternative to a wire coronode charging device, the operable portion of the device has a length which corresponds to the width of a surface to be charged. The width of the device is variable depending on the needs of, and the placement in, a particular electrostatographic system. Since the robust structure may be precisely positioned and has no vibration and sagging problems normally associated with wire coronodes, the device of the present invention is especially useful for wide body copy machines.

Figure 5:
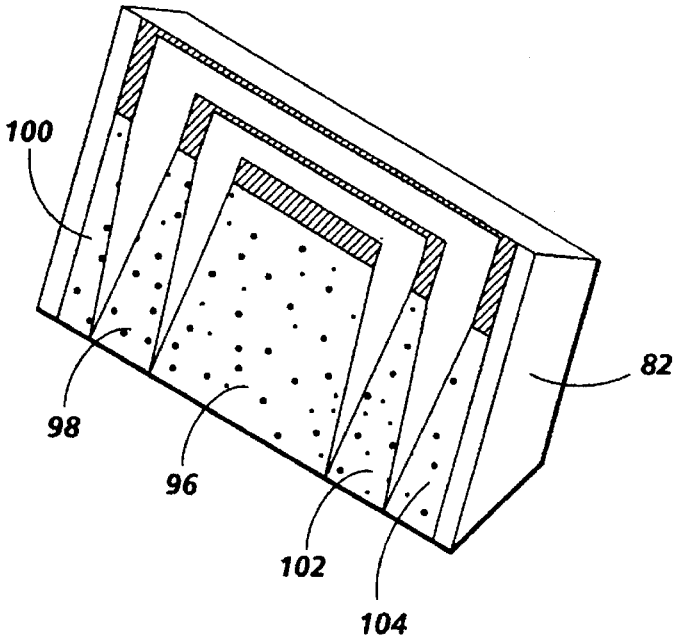
FIG. 5 is a perspective view of an alternative embodiment of the present invention having segmented resistive material regions.

In an alternative embodiment, the charging structure of the present invention can also include segmented resistive material regions, shown in FIG. 5, suitable for selectively charging a charge retentive surface or a dielectric substrate in accordance with the particular size of copy sheet to which a toner image will eventually be transferred. As may be seen in the alternative embodiment of FIG. 5, a central segment 96 is driven separately from edge segments 98, 100, 102 and 104, which may, for example, be selectively driven in accordance with selected sheet size. In the described embodiment, end segments 98, 100 may be paired with counterpart segments 102, 104, respectively, on the opposite side of the central segment 96, to provide a non-charging condition at the sheet edges eliminating the need for edge erase lamps to dissipate charge in areas adjacent to image formation by not charging these areas. These segments are selectively driven to a charge producing condition when larger size sheets require a greater proportion of the charge retentive surface to be charged. In like manner, a reasonable extension of this arrangement could provide a larger number of individual selectively controlled segments for applying a charge to the surface of an annotation or printing scheme. Thus, segments would be selectively driven to charge relatively small areas of the charge retentive surface, in accordance with the annotation required. Assuming no dissipation of the charge in these areas by exposure to image radiation, these areas will be developed as an annotation or selective printing area on the substrate.

If it is desired that a charge not be deposited at any selected area on the charge retentive surface, the edge of the resistive area adjacent that portion of the charge retentive surface may be overcoated with a dielectric having electrical properties similar to the insulative substrate. Alternatively, the gap between the resistive material and the charge retentive surface may be widened at that point so that the threshold voltage is increased for that portion of the gap.

In recapitulation, it should now be clear from the foregoing discussion that the apparatus of the present invention provides a novel charging device in which the coronode consists of an insulative substrate having a resistive coating thereon which is provided with a voltage potential for depositing a relatively uniform charge on a dielectric layer. In electrostatographic applications, the capacity of the dielectric to be charged is relatively low and the process speed is finite, such that the charge exchange rate required in a system utilizing the present invention is typically small. Due to the controlled rate of charging, however, the ion source never completely extinguishes itself and, therefore, the charging device of the present invention readily provides additional ions where needed for those regions on the dielectric that may not otherwise by fully charged. It is believed that the potential distribution on the dielectric being charged adjusts itself during the charging process in such a way that the undercharged areas tend to become "filled in" with the additional ions, leading to a uniform deposition of ions on the dielectric layer. This model assumes that the resistivity of the source is not too high, that is, that the charging time constant is longer than the effective receiver dwell time which would lead to a charge starved condition. This would result in relatively low surface voltages and reflect any lack of uniformity of the source resistance.

It is, therefore, apparent that there has been provided, in accordance with the present invention, a resistive ion source charging structure that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. A device for generating ions, comprising:

an insulative support substrate defined by a planar member;

a highly resistive material coating layer uniformly disposed on said support substrate to form a singular continuous resistive material region extending along a single edge of said support substrate;

a power supply; and means for connecting said resistive material layer to said power supply for providing a voltage potential across said resistive material region to emit ions therefrom along said single edge.

2. The device for generating ions of claim 1, wherein said means for connecting said resistive material layer to said power supply includes a unitary voltage bus.

3. The device for generating ions of claim 1, wherein said highly resistive material layer is formed of a material having volume resistivity between 1–1,000 megohms per square.

4. The device for generating ions of claim 1, wherein said resistive material layer has a substantially uniform thickness between 0.1 micron and 1 mm.

5. A device for generating ions wherein said device is positioned substantially proximate to a dielectric substrate surface to be charged so as to form an air gap therebetween across which charge is transferred, said device comprising:

an insulative support substrate;

a highly resistive material layer uniformly disposed on said support substrate to form a singular resistive material region extending along a single edge of said support substrate;

a power supply; and means for connecting said resistive material layer to said power supply for providing a voltage potential across said resistive material region to emit ions therefrom along said single edge.

6. The device for generating ions of claim 5, wherein said air gap is less than 10 mm.

7. The device for generating ions of claim 1, wherein said device is positioned to substantially abut a dielectric substrate surface to be charged to form a contact therewith.

8. The device for generating ions of claim 1, wherein said means for connecting said resistive material layer to said power supply includes a contact tab for providing an electrical connection therebetween.

9. The device for generating ions of claim 5, including a dielectric material layer covering at least a selective portion of said resistive material region along said resistive edge.

10. The device for generating ions of claim 5, wherein:

said highly resistive material region is divided into a plurality of charging segments; and said means for connecting said resistive material layer to said power supply includes a plurality of voltage buses, each coupled to at least one of said plurality of charging segments for selectively providing a voltage potential across a corresponding charging segment to emit ions therefrom along said resistive edge of said support substrate.

11. The device for generating ions of claim 10, wherein said plurality of charging segments includes a central charging segment and at least one pair of side charging segments positioned symmetrically about said central charging segment.

12. An electrostatographic printing apparatus having at least one resistive ion source charging device for depositing charge on a charge retentive surface, comprising;

an insulative support substrate defined by a planar member;

a highly resistive material coating layer uniformly disposed on said support substrate to form a singular continuous resistive material region extending along a single edge of said support substrate;

a power supply; and means for connecting said resistive material layer to said power supply for providing a voltage potential across said resistive material region to emit ions therefrom along said single edge.

13. The electrostatographic printing apparatus of claim 12, wherein said means for connecting said resistive material layer to said power supply includes a unitary high voltage bus.

14. The electrostatographic printing apparatus of claim 12, wherein said highly resistive material layer is formed of a material having volume resistivity between 1–1,000 megohms per square.

15. The electrostatographic printing apparatus of claim 12, wherein said resistive material layer has a substantially uniform thickness between 0.1 micron and 1 mm.

16. An electrostatographic printing apparatus having at least one resistive ion source charging device for depositing charge on a charge retentive surface wherein said charging device is positioned substantially proximate to a dielectric substrate surface to be charged so as to form an air gap therebetween across which charge is transferred, said charging device comprising:

an insulative support substrate;

a highly resistive material layer uniformly disposed on said support substrate to form a singular resistive material region extending along a single edge of said support substrate;

a power supply; and means for connecting said resistive material layer to said power supply for providing a voltage potential across said resistive material region to emit ions therefrom along said single edge.

17. The electrostatographic printing apparatus of claim 16, wherein said air gap is less than 10 mm.

18. The electrostatographic printing apparatus of claim 12, wherein said charging device is positioned to substantially abut a dielectric substrate surface to be charged to form a contact therewith.

19. The electrostatographic printing apparatus of claim 12, wherein said means for connecting said resistive material layer to said power supply includes a contact tab for providing an electrical connection to said high voltage bus.

20. The electrostatographic printing apparatus of claim 16, including a dielectric material layer covering at least a selective portion of said resistive material region along said resistive edge.

21. The electrostatographic printing apparatus of claim 16, wherein:

said highly resistive material region is divided into a plurality of charging segments; and said means for connecting said resistive material layer to said power supply includes a plurality of voltage buses, each coupled to at least one of said plurality of charging segments for selectively providing a voltage potential across a corresponding charging segment to emit ions therefrom along said resistive edge of said support substrate.

22. The electrostatographic printing apparatus of claim 21, wherein said plurality of charging segments includes a central charging segment and at least one pair of side charging segments positioned symmetrically about said central charging segment.

* * * * *